United States Patent [19]

Meulenberg et al.

[11] Patent Number: 4,752,006

[45] Date of Patent: Jun. 21, 1988

[54] SHEATH FOR LACING HOOKS

[75] Inventors: John H. Meulenberg, Jenison; Roy A. McKeage, Grand Rapids, both of Mich.

[73] Assignee: Clipper Belt Lacer Company, Grand Rapids, Mich.

[21] Appl. No.: 869,406

[22] Filed: Jun. 2, 1986

[51] Int. Cl.[4] ..... B65D 85/24

[52] U.S. Cl. ..... 206/341; 206/340; 206/345; 206/347

[58] Field of Search ..... 206/338, 340, 341, 345, 206/347, 346

[56] References Cited

U.S. PATENT DOCUMENTS

| | | | |
|---|---|---|---|
| 948,574 | 2/1910 | Conn . | |
| 1,066,801 | 7/1913 | Diamond | 206/341 |
| 1,183,173 | 5/1916 | Diamond . | |
| 1,198,897 | 9/1916 | Diamond | 206/341 |
| 1,393,451 | 10/1921 | Nicholson . | |
| 1,498,275 | 6/1924 | Hartley . | |
| 1,660,644 | 2/1928 | Coats | 206/341 |
| 1,768,935 | 7/1930 | Schnelle . | |
| 1,801,566 | 4/1931 | Olsen . | |
| 1,885,237 | 11/1932 | Diamond . | |
| 1,894,981 | 1/1933 | Diamond . | |
| 2,015,492 | 9/1935 | Messinger | 1/56 |
| 2,023,220 | 12/1935 | Diamond | 1/56 |
| 2,164,049 | 6/1939 | Bray | 1/56 |
| 2,420,783 | 5/1947 | Koester | 1/56 |
| 2,481,085 | 9/1949 | Claus | 1/56 |

FOREIGN PATENT DOCUMENTS

| | | |
|---|---|---|
| 491158 | of 1918 | France . |
| 564511 | 3/1923 | France . |
| 115448 | 5/1918 | United Kingdom . |
| 228022 | 1/1925 | United Kingdom . |

OTHER PUBLICATIONS

Photographs of prior rigid "H" shaped hook guard, first use date unknown.

*Primary Examiner*—David T. Fidei

*Attorney, Agent, or Firm*—Price, Heneveld, Cooper, DeWitt & Litton

[57] ABSTRACT

A sheath is provided for lacing hooks and the like, and comprises a channel-shaped body having a web with flanges extending along opposite sides of the web. The sheath flanges include outwardly facing apertures in which sharpened points of the hooks are received. The web is readily deformable, so that it can be manually compressed between its opposite sides to converge the apertures, and thereby disengage the hook points received therein. The sheath may then be removed from the hooks by simply pulling the sheath outwardly from inbetween the hook points. The sheath also facilitates manually severing a strip bar-type of lacing hooks to length. The sheath is preferably constructed from a material such as stiff paper materials, cardboard, thin plastic, et cetera, which can be manually cut by a conventional knife edge, like scissors, or a pocket knife. The web covers the hook points from the exterior side of the strip, such that the sheath can be cut, and the opposite ends of the strip grasped firmly in the user's hands, and manually twisted about the welded bar which interconnects adjacent hooks to break the strip to the desired length.

32 Claims, 1 Drawing Sheet

SHEATH FOR LACING HOOKS

BACKGROUND OF THE INVENTION

The present invention relates to fastening systems for belting, and in particular to a sheath for lacing hooks, and the like.

Endless belts are used extensively in a wide variety of different commercial and industrial applications, such as conveyor belts and power drive belts in agricultural equipment, airport baggage conveyor systems, mining conveyors, and many other similar systems. The ends of such endless belts are typically interconnected by a lacing, which is usually flexible to permit the belt to pass over pulleys. One common type of lacing comprises a plurality of wire hooks that have sharpened points on opposite legs clenched or embedded in the leading and trailing ends of the belt. The loop ends of the hooks are meshed together, and a pin extends through the meshed loops to interconnect the opposite ends of the belt.

One type of wire hook lacing employs "carded hooks," which comprise separate hooks that are individually mounted on a piece of cardboard or a card of similar material to retain the same in their proper spacing and orientation for insertion into a crimping machine. Examples of such carded hooks are disclosed in U.S. Pat. Nos. 1,393,451 and 1,894,981. Once the carded hooks are set in place in the crimping machine, the card is removed, and a jaw portion of the crimping machine then retains the hooks in place as they are crimped onto one end of the belt.

Another type of wire hook lacing employs "bar hooks," or "welded bar hooks," which comprise a plurality of hooks that are rigidly interconnected in a side-by-side relationship to form a strip of hooks. The rigid interconnection of the hooks both facilitates insertion of the hooks into a crimping machine, and also reinforces the finished lacing. Examples of such bar hooks are disclosed in U.S. Pat. Nos. 1,498,275 and 1,768,935. In one type of bar hook, a rigid wire or bar extends laterally across the hooks, and is welded to a leg of each hook at the point of intersection.

The sharpened points of lacing hooks are normally exposed, such that the strips of hooks often become tangled during transport and/or use, which requires rather tedious and time consuming untangling. Also, due to the exposed points on unguarded lacing hooks, the hooks must be handled very carefully to avoid injury.

One prior device used to guard the points of bar hooks is disclosed in an associated "Disclosure Statement," and comprises a rigid, extruded plastic strip having an H-shaped end elevational configuration. This rigid, H-shaped guard strip is slid laterally across the bar hooks, with the outermost hook points positioned within oppositely facing spaces between the upper and lower flanges of the guard strip.

The rigid, H-shaped guard strip discussed above is relatively expensive to manufacture, and is simply discarded after the lacing is completed. Also, the rigid, H-shaped guard strip must be slid laterally off of the bar hooks to be removed therefrom prior to crimping. This type of removal action presents a problem where side clearance is limited, which is particularly prevalent when a belt is laced in place, since conveyor guides, side panels, et cetera, create a lateral obstruction.

Another drawback associated with the use of such rigid, H-shaped guards is that when the bar-hooks are cut to length, the guard must be either removed or repositioned before the strip of bar hooks can be severed, thereby exposing at least some of the hook points.

Yet another disadvantage associated with the H-shaped type of guard strip is that because they are rigid, and the spaces between the upper and lower flanges are relatively wide to insure proper insertion onto the bar hooks points, the guards have a tendency to slide laterally along the length of the bar hook during transport and/or use. This lateral motion causes longitudinal misalignment between the bar hooks and the guard that can expose some of the outermost hooks.

SUMMARY OF THE INVENTION

One aspect of the present invention is to provide a sheath for lacing hooks, and the like, of the kind comprising a plurality of individual hooks that have sharpened points, and are interconnected in a side-by-side relationship. The sheath comprises a channel-shaped sheath body having a web with flanges extending along opposite sides of the web. The flanges include outwardly facing apertures that are shaped to receive therein the points of at least one of the hooks. The sheath also includes means for permitting the web to be manually compressed or collapsed between the opposite sides thereof to the extent that the apertures converge, and at least partially disengage the points of the hooks disposed therein, such that the sheath can be removed from the hooks by pulling the sheath outwardly from inbetween the points of the hooks.

Yet another aspect of the present invention is to provide a sheath for bar-type lacing hooks, and the like, of the type having a laterally extending bar attached to each of the hooks to retain the hooks side-by-side in a strip. The sheath comprises a channel-shaped body having a web with flanges extending along opposite sides of the web. The flanges include an aperture shaped to receive therein the points of the hooks. The web is shaped to cover the points of the hooks from an exterior side of the bar hook strip, and the sheath body is constructed from a sliceable material adapted to be manually cut by a conventional knife edge. Hence, the strip of bar hooks can be severed or broken manually to length by cutting the sheath at a selected location, grasping the strip with hands on opposite sides of the cut, and rotating one end of the strip with respect to the other end of the strip generally about the longitudinal axis of the bar to torsionally fatigue and break the bar at the selected location.

The principal objects of the present invention are to provide a sheath for lacing hooks, and the like, which is economical to manufacture, and can be easily removed from the hooks, even in environments having very limited lateral or side clearance. The sheath provides improved safety during handling of the hooks, and greatly alleviates tangling.

Preferably, the sheath also serves as a mechanism by which a strip of bar hooks can be manually severed to length, and the only tool required is a simple cutting edge, such as a pocket knife, or the like. The sheath is efficient in use, capable of a long operating life, and particularly well adapted for the proposed use.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 6:
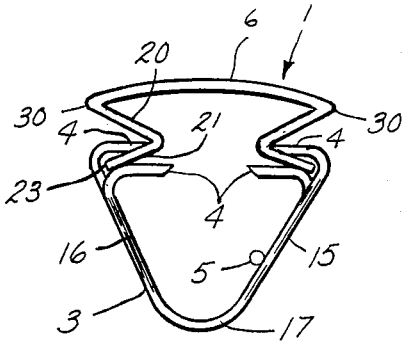
FIG. 6 is a slightly enlarged, end elevational view of the sheath, shown engaged with the bar hook strip.
Figure 7:
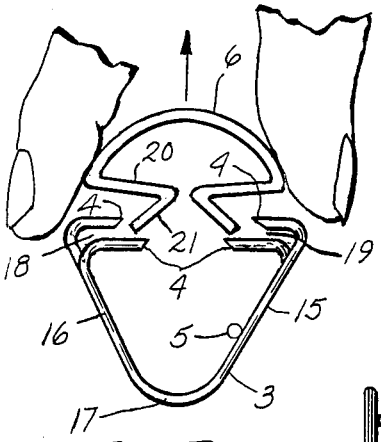
FIG. 7 is a slightly enlarged, end elevational view of the sheath, shown compressed to disengage the bar hook strip.

For purposes of description herein, the terms "upper," "lower," "right," "left," "rear," "front," "vertical," "horizontal" and derivatives thereof shall relate to the invention as oriented in FIGS. 6 and 7. However, it is to be understood that the invention may assume various alternative orientations, except where expressly specified to the contrary. It is also to be understood that the specific device and processes illustrated in the attached drawings, and described in the following specification, are simply exemplary embodiments of the inventive concepts defined in the appended claims. Hence, specific dimensions and other physical characteristics relating to the embodiments disclosed herein are not to be considered limiting, unless the claims expressly state otherwise.

Figure 1:
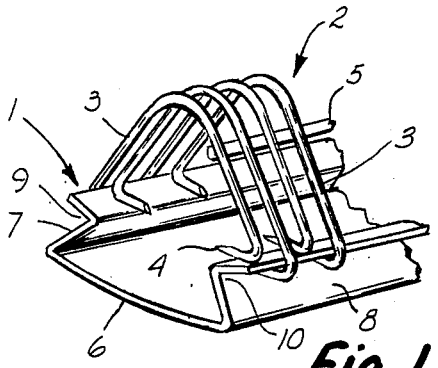
FIG. 1 is a perspective view of a strip of bar-type lacing hooks, having a sheath which embodies the present invention mounted thereon.

The reference numeral 1 (FIG. 1) generally designates a sheath embodying the present invention. Sheath 1 is shown attached to a strip of bar-type lacing hooks 2 of the kind comprising a plurality of individual hooks 3 that have sharpened points 4, and are rigidly interconnected in a side-by-side relationship by means such as the illustrated bar 5. Sheath 1 has a channel-shaped body, comprising a web 6 with flanges 7 and 8 extending along opposite sides of web 6. Flanges 7 and 8 include outwardly facing apertures or spaces 9 and 10 in which at least some of the sharpened points 4 of hooks 3 are received. The web 6 of sheath 1 is readily deformable, such as in the manner illustrated in FIG. 7, wherein web 6 is manually compressed between its opposite side edges to converge apertures or spaces 9 and 10, and thereby disengage hook points 4. Sheath 1 may then be removed by simply pulling the same outwardly from inbetween the hook points, generally in the direction of the arrow illustrated in FIG. 7.

Sheath 1 (FIG. 8) also facilitates manually severing the strip of bar hooks 2 to length. Sheath 1 is preferably constructed from a material that can be manually cut by a conventional knife edge, such as stiff paper, cardboard, et cetera. Web 6 covers hook points 4 from the exterior side of strip 2, such that sheath 1 can be cut, and the opposite ends of strip 2 firmly grasped in the user's hands and manually twisted axially about the longitudinal axis of bar 5 to torsionally fatigue and break strip 2 to the desired length.

It is to be understood that the term "bar hooks," as used herein contemplates any type of lacing hook system in which the individual hooks are rigidly interconnected in a side-by-side relationship, regardless of the means by which such interconnection is accomplished. Hence, while the lacing hooks 2 described and illustrated herein are considered bar hooks and employ transverse interconnecting bar 5, sheath 1 may be used with other functionally similar lacing arrangements.

The illustrated bar hooks strip 2 has a generally conventional construction, wherein the individual hooks 3 each have a long leg 15 (FIG. 7), a short leg 16, and a loop area 17 between the long and short legs 15 and 16. Both the long and short legs 15 and 16 of hooks 3 have sharpened points 4 at their free ends. The illustrated hooks 3 are arranged in an alternate, side-by-side fashion, with the long leg 15 of each hook 3 disposed adjacent to the short leg 16 of the next adjacent hook 3. This alternate positioning of the hooks 3 in bar hook strip 2 is designed to reduce structural damage to the carcass of the belt into which hooks 3 are crimped. As best illustrated in FIGS. 6 and 7, the alternate positioning of hooks 3 also creates two apertures or gaps 18 and 19 in bar hook strip 2 between the upper and lower hook points 4, as viewed in side elevation.

In the illustrated embodiment of the present invention, sheath 1 has an integral, one-piece type of construction in the form of an elongate strip. Apertures or spaces 9 and 10 comprise V-shaped grooves, which extend continuously along the length of flanges 7 and 8. Grooves 9 and 10 are defined by inner and outer leg portions 20 and 21 of flanges 7 and 8. Inner and outer legs 20 and 21 intersect along a base portion 22 of grooves 9 and 10, and are mutually inclined at an included angle in the range of 30 to 60 degrees. The illustrated inner leg 20 is slightly longer than outer leg 21, which includes a free end edge 23.

The illustrated web 6 (FIG. 6) of sheath 1 has an arcuate configuration, which opens toward bar hooks 3. The arcuate shape of web 6 facilitates the removal of sheath 1 from bar hooks 3, as described in greater detail hereinafter. The opposite side edges 3O of web 6 extend over the points 4 of hooks 3, such that sheath 1 covers all of the points 4 in bar hook strip 2 from the exterior side of strip 2.

The web portion 6 of sheath 1 also includes means for permitting web 6 to be manually deformed or compressed between the opposite side edges 30 of web 6 to the extent that grooves 9 and 10 converge, and at least partially disengage the points 4 of the bar hooks 5 disposed therein. Sheath 1 can then be removed from bar hook strip 2 by pulling sheath 1 outwardly from inbetween the points 4 of hooks 3, generally along the line of the arrow illustrated in FIG. 7. In the illustrated example of the present invention, the means by which web 6 can be manually compressed comprises constructing sheath 1 from a strip of manually deformable material, such as cellulose materials in the nature of stiff paper, cardboard, et cetera, and other materials having a similar characteristic.

Figure 2:
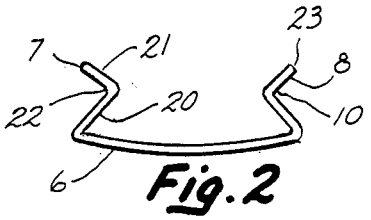
FIG. 2 is an end elevational view of the sheath.
Figure 5:
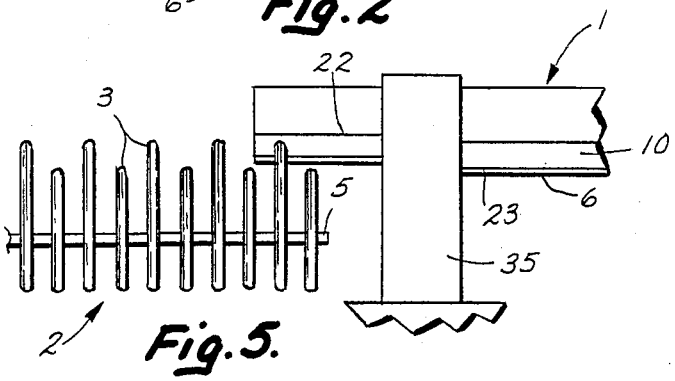
FIG. 5 is a diagrammatic illustration of the insertion of the sheath onto the bar hook strip.

It is to be understood that the present invention also contemplates other means which will enable web 6 to be manually deformed or compressed. For instance a spring loaded hinge along web 6 would also serve to secure sheath 1 to the strip of bar hooks 2, yet permit manual compression of web 6 to the extent that grooves 9 and 10 would disengage hook points 4. In one example of the present invention, sheath 1 is constructed by folding a relatively thin strip of stiff paper into the somewhat Omega-shaped configuration illustrated in the drawings. Fold lines or creases are made along the side edges 30 of web 6, as well as the base 22 of grooves 9 and 10. The folded, paper strip construction provides sheath 1 with resiliency both in web 6, and flanges 7 and 8. In one example of the present invention, when sheath 1 is in a free condition, unattached to hooks 3, as illustrated in FIG. 2, flanges 7 and 8 are sprung slightly away from web 6. Hence, as illustrated in FIG. 5, a positioning fixture 35 is used to insert sheath 1 onto the strip of bar hooks 2. In the example illustrated in FIG. 5, fixture 35 positions the outer legs 21 of flanges 7 and 8 directly in line with the gap 18 and 19 between alternate hook points 4. Fixture 35 flexes flanges 7 and 8 and web 6 towards each other to achieve this positioning action. As sheath 1 extends away from fixture 35, sheath 1 springs or expands outwardly toward its free position, thereby capturing and locking the outer legs 21 of sheath 1 between the adjacent, alternate hook points 4 which define gaps 18 and 19, as shown in FIG. 6. In this position, the free edges 23 of flanges 7 and 8 are disposed adjacent to the inside surfaces of hook legs 15 and 16. The springing action of flanges 7 and 8 not only tends to laterally retain sheath 1 in position on hooks 3, but also locates the side edges 30 of web 6 at a convenient position to be grasped for removal.

It is to be understood that sheath 1 is capable of being manufactured from a variety of different materials, and by various processes. For instance, in addition to being folded from stiff paper, the present invention contemplates that sheath 1 may be constructed by extruding a relatively thin-walled channel of a semi-rigid polymer or plastic. Other similar constructions that provide a manually deformable web are also contemplated by the present invention.

Figure 3:
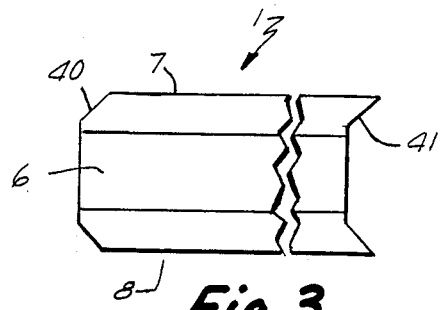
FIG. 3 is a fragmentary, top plan view of the sheath.
Figure 4:
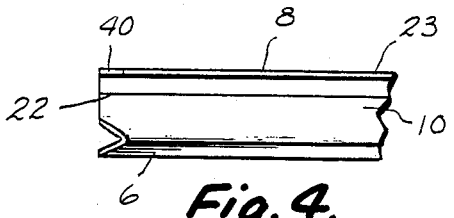
FIG. 4 is a fragmentary, side elevational view of the sheath.

The sheath illustrated in FIGS. 3 and 4 includes a tapered lead end 40, which facilitates inserting sheath 1 onto the strip of bar hooks 2. The trailing end 41 of sheath 1 includes a reverse taper, in the nature of an arrow, which matches leading end 40 to facilitate manufacture.

In operation, sheath 1 may be inserted onto the strip of bar hooks 2 by fixture 35, in the manner discussed above. Sheath 1 protects or shields all of the hook points 4 on strip 2 to maintain point sharpness, provide improved safety, and prevent adjacent strips of bar hooks 2 from becoming entangled. After the strip of bar hooks 2 is placed and set in a conventional clenching or crimping machine (not shown), sheath 1 can be easily removed in the following manner. The user manually compresses or partially collapses web 6 by pinching side edges 30, as shown in FIG. 7. This compressing action, which is enhanced by and cooperates with the arcuate shape of web 6, causes grooves 9 and 10 to converge and disengage or uncover the points 4 of hooks 3 previously disposed therein. The outer legs 21 of flanges 7 and 8 are thus pulled out from the gaps 18 and 19 between adjacent rows of hook points 4. Sheath 1 is then removed by pulling sheath 1 directly outwardly from inbetween hook points 4. Since sheath 1 need not be slid laterally along gaps 18 and 19, sheath 1 requires virtually no lateral side clearance for removal.

Figure 8:
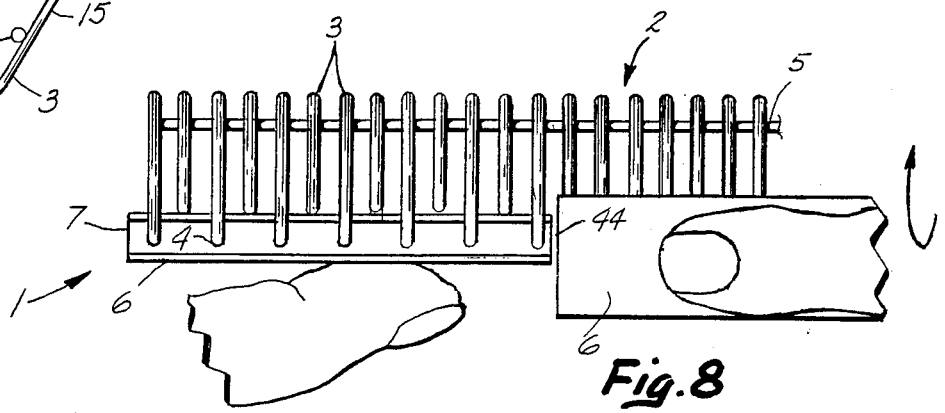
FIG. 8 is a diagrammatic illustration of the bar hooks and sheath, wherein the sheath has been cut, and the opposite ends of the bar hook strip have been rotated to torsionally fatigue and break the bar hook strip to length.

Sheath 1 also provides a mechanism by which the strip of bar hooks 2 can be manually broken or severed to a length that will accommodate the width of the belt to be spliced. As best illustrated in FIG. 8, sheath 1 is cut at the location of the selected length by means of a conventional cutting edge, such as a standard pocket-knife, craft-knife, scissors, or the like. The user then firmly grasps the strip of bar hooks 2 with both hands, wherein opposite hands are located on opposite sides of the cut line 44. Preferably, the user's thumbs are placed directly in the center of web 6, and the user presses firmly inwardly thereon to compress web 6 against the upper set of hook points 4 in the manner illustrated in FIG. 8. The user then manually rotates the opposite ends of strip 2 (i.e., on opposite sides of cut line 44) along an axis generally concentric with the longitudinal axis of bar 5 (as illustrated by the arrow in FIG. 8) to torsionally fatigue the same, and thereby break bar 5 at the selected location. In this manner, the strip of bar hooks 3 can be manually severed to length, without the need for any special tool.

Sheath 1 provides an economical means by which to shield the hook points 4 on fastener hooks. Sheath 1 can be easily removed from a strip of hooks 2, even in places having virtually no lateral or side clearance. Sheath 1 is securely retained on hooks 3 to improve safety and avoid tangling of adjacent hook strips 2. Sheath 1 also provides a convenient and safe mechanism by which a strip of bar-type hooks 2 can be manually severed to length, without requiring any special tools.

In the foregoing description, it will be readily appreciated by those skilled in the art, that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A sheath for lacing hooks, and the like, of the kind comprising a plurality of individual hooks that have sharpened points and are interconnected in a side-by-side relationship; said sheath comprising:

a channel-shaped sheath body having a web with flanges extending along opposite side edges of said web; said flanges being configured to define outwardly facing spaces shaped to receive therein and cover the points of at least one of the hooks; said opposite side edges of said web being disposed outside of the lacing hooks to permit manually grasping the same, and said sheath including means for permitting said web to be manually compressed between the opposite side edges of said web to the extent that said spaces converge and at least partially disengage the points of the hooks disposed therein, such that said sheath can then be removed from the hooks by pulling said sheath outwardly from inbetween the points of the hooks.

2. A sheath as set forth in claim 1, wherein:

said spaces comprise grooves in said flanges which extend continuously along the length of said flanges.

3. A sheath as set forth in claim 2, wherein:

said web has a generally arcuate shape which opens towards the hooks to facilitate removal of said sheath.

4. A sheath as set forth in claim 3, wherein:

said sheath body has a one-piece, integral construction.

5. A sheath as set forth in claim 4, wherein:

said grooves each have a generally V-shaped transverse cross-sectional configuration.

6. A sheath as set forth in claim 5, wherein:
said sheath body is constructed from a thin strip of deformable material that is folded to form said web and said flanges.

7. A sheath as set forth in claim 6, wherein:
said sheath is constructed from a cellulose material.

8. A sheath as set forth in claim 7, wherein:
said grooves are each defined by a first leg connected with said web, and a second leg connected with said first leg; and
said first and second legs are positioned in a predetermined relationship, wherein said second leg is adapted to be received inbetween rows of alternately arranged points on the hooks.

9. A sheath as set forth in claim 8, wherein:
said sheath body has a tapered end to facilitate inserting said sheath into the hooks.

10. A sheath as set forth in claim 1, wherein:
said web has a generally arcuate shape which opens towards the hooks to facilitate removal of said sheath.

11. A sheath as set forth in claim 1, wherein:
said sheath body has a one-piece, integral construction.

12. A sheath as set forth in claim 1, wherein:
said sheath body is constructed from a thin strip of deformable material that is folded to form said web and said flanges.

13. A fastener for belts, and the like, comprising:
a plurality of individual hooks having sharpened points, and means for interconnecting said hooks in a side-by-side relationship;
a sheath having a channel-shaped body with a web, and first and second flanges extending along opposite side edges of said web; said first and second flanges being configured to define facing spaces in which the points of said hooks are received and covered; said sheath including means for permitting said web to be manually compressed between the opposite edges thereof to the extent that said spaces converge and at least partially disengage the points of said hooks disposed therein, such that said sheath can then be removed from said hooks by pulling said sheath outwardly from inbetween the points of said hooks.

14. A fastener as set forth in claim 13, wherein:
at least two of said hooks have alternately positioned points that define a gap therebetween; and at least one of said first and second flanges includes a free leg shaped for reception in said gap.

15. A fastener as set forth in claim 13, wherein:
said first and second flanges include a first free leg and a second free leg;
said hooks each have first and second legs, with the length of said first leg being greater than the length of said second leg; and
said hooks are arranged such that the first leg of each of said hooks is disposed laterally adjacent to the second leg of the next adjacent one of said hooks to define first and second gaps between the points of said hooks into which the first and second legs of said flanges are received.

16. A fastener as set forth in claim 15, wherein:
said comprise first and second grooves in said first and second flanges which extend continuously along the length of said first and second flanges.

17. A fastener as set forth in claim 16, wherein:
said web has a generally arcuate shape which opens towards the hooks to facilitate removal of said sheath.

18. A fastener as set forth in claim 17, wherein:
said sheath body has a one-piece, integral construction.

19. A fastener as set forth in claim 18, wherein:
said first and second grooves have a generally V-shaped transverse cross-sectional configuration.

20. A fastener as set forth in claim 19, wherein:
said sheath body is constructed from a thin strip of deformable material that is folded to form said web and said first and second flanges.

21. A fastener as set forth in claim 20, wherein:
said sheath is constructed from a cellulose material.

22. A sheath for bar-type lacing hooks, and the like, of the kind comprising a plurality of individual hooks that have sharpened points and are rigidly attached to a bar to retain the hooks side-by-side in a strip; said sheath comprising:
a channel-shaped sheath body having a web with flanges extending along opposite side edges of said web; said flanges being configured to define spaces shaped to receive therein and cover the points of the hooks; said web being shaped to cover the points of the hooks from an exterior side of the strip; said sheath body being constructed from a sliceable material adapted to be manually cut by a knife edge, whereby the strip of hooks can be severed manually to length by cutting said sheath at a selected location, grasping the strip with hands disposed on opposite sides of the cut, selected location, and rotating one end of the strip with respect to the other end of the strip generally about the longitudinal axis of the bar to torsionally fatigue and break the bar, and wherein said sheath includes means for permitting said web to be manually compressed between the opposite side edges thereof to the extent that said spaces converge and at least partially disengage the points of the hooks disposed therein, such that said sheath can then be removed from the hooks by pulling said sheath outwardly from inbetween the points of the hooks.

23. A sheath as set forth in claim 22, wherein:
said spaces comprise first and second grooves extending continuously along said first and second flanges.

24. A sheath as set forth in claim 23, wherein:
said web has a generally arcuate shape which opens towards the hooks.

25. A sheath as set forth in claim 24, wherein:
said sheath body has a one-piece, integral construction.

26. A sheath as set forth in claim 25, wherein:
said sheath body is constructed from a thin strip of deformable material that is folded to form said web and said flanges.

27. A fastener for belts, and the like, comprising:
a plurality of individual hooks having sharpened points and a bar rigidly attached to each of said hooks to retain the same side-by-side in a strip;
a sheath having a channel-shaped body with a web, and first and second flanges extending along opposite sides of said web; said first and second flanges being configured to define spaces shaped to receive therein the points of said hooks; said web being shaped to cover the points of said hooks from an exterior side of said strip; said sheath body being constructed from a sliceable material adapted to be manually cut by a knife edge, whereby said strip can be severed manually to length by cutting said sheath at a selected location, grasping the strip with hands disposed on opposite sides of the cut, selected location, and rotating one end of said strip with respect to the other end of said strip generally about the longitudinal axis of said bar to torsionally fatigue and break said bar, and wherein said sheath includes means for permitting said web to be manually compressed between the opposite side edges thereof to the extent that said spaces converge and at least partially disengage the points of said hooks disposed therein, such that said sheath can then be removed from said hooks by pulling said sheath outwardly from inbetween the points of said hooks.

28. A fastener as set forth in claim 27, wherein:

said spaces comprise first and second grooves extending continuously along said first and second flanges.

29. A fastener as set forth in claim 28, wherein:

said web has a generally arcuate shape which opens towards said hooks.

30. A fastener as set forth in claim 29, wherein:

said sheath body has a one-piece, integral construction.

31. A fastener as set forth in claim 30, wherein:

said sheath body is constructed from a thin strip of deformable material that is folded to form said web and said flanges.

32. A fastener as set forth in claim 21, wherein:

said hooks comprise bar-type lacing hooks with adjacent hooks rigidly interconnected by a laterally extending bar that is fixedly connected with each of said hooks.

* * * * *

UNITED STATES PATENT AND TRADEMARK OFFICE

CERTIFICATE OF CORRECTION

PATENT NO. : 4,752,006

DATED : June 21, 1988

INVENTOR(S) : John H. Meulenberg et al.

It is certified that error appears in the above-identified patent and that said Letters Patent is hereby corrected as shown below:

Column 4, line 44:
"30" should be --30--;

Column 5, line 16:
"gap" should be --gaps--;

Column 7, line 66, Claim 16:
"said comprise" should be --said spaces comprise--.

Signed and Sealed this

Fourth Day of October, 1988

*Attest:*

*Attesting Officer*

DONALD J. QUIGG

*Commissioner of Patents and Trademarks*